US008021171B2

(12) United States Patent
Buettner

(10) Patent No.: US 8,021,171 B2
(45) Date of Patent: Sep. 20, 2011

(54) CONNECTION MODULE FOR SWITCHING DEVICE AND CONNECTION RAIL

(75) Inventor: Alex Buettner, Rodental (DE)

(73) Assignee: Woehner GmbH & Co., KG Elektrotechnische Systeme, Rodental (DE)

( * ) Notice: Subject to any disclaimer, the term of this patent is extended or adjusted under 35 U.S.C. 154(b) by 0 days.

(21) Appl. No.: 12/741,263

(22) PCT Filed: Sep. 3, 2008

(86) PCT No.: PCT/EP2008/061614

§ 371 (c)(1),
(2), (4) Date: May 4, 2010

(87) PCT Pub. No.: WO2009/059824

PCT Pub. Date: May 14, 2009

(65) Prior Publication Data

US 2010/0233893 A1 Sep. 16, 2010

(30) Foreign Application Priority Data

Nov. 9, 2007 (DE) ..... 10 2007 053 535

(51) Int. Cl.
*H01R 25/00* (2006.01)
*H01H 85/22* (2006.01)
*H01H 71/20* (2006.01)

(52) U.S. Cl. ..... 439/121; 337/196

(58) Field of Classification Search ..... 439/121, 439/122, 721; 200/172, 337; 337/181, 196
See application file for complete search history.

(56) References Cited

U.S. PATENT DOCUMENTS

| | | | | |
|---|---|---|---|---|
| 3,172,984 A | | 3/1965 | Cellerini et al. | 200/172 |
| 4,861,273 A | * | 8/1989 | Wenman et al. | 439/111 |
| 6,634,895 B2 | * | 10/2003 | Agro | 439/121 |
| 7,932,804 B2 | * | 4/2011 | Buettner | 337/196 |
| 2002/0045369 A1 | * | 4/2002 | Agro | 439/121 |
| 2009/0231082 A1 | | 9/2009 | Buettner | 337/181 |

FOREIGN PATENT DOCUMENTS

| | | |
|---|---|---|
| DE | 40 03 260 A1 | 8/1991 |
| DE | 297 21 440 U1 | 6/1998 |
| DE | 298 22 620 U1 | 4/1999 |
| DE | 10 2006 022 374 A1 | 11/2007 |

OTHER PUBLICATIONS

International Search Report, PCT/EP2008/061614.
Notification of Transmittal of Translation of the International Preliminary Report on Patentability for PCT/EP2008/061614 filed Sep. 3, 2008 dated Jun. 18, 2010, 9 pages.

* cited by examiner

*Primary Examiner* — Chandrika Prasad
(74) *Attorney, Agent, or Firm* — Westman, Champlin & Kelly, P.A.

(57) ABSTRACT

The invention relates to a connection module, particularly for use between a switching device and a busbar adapter, having a base plate, comprising a plurality of contacts disposed parallel to each other and parallel to a longitudinal axis of the base plate, wherein the contacts have contact ends configured as input and output sections, which are positioned substantially in the same plane, wherein the contact ends forming the input sections are disposed on one side of the base plate and the contact ends forming the output sections are disposed on the opposite side of the base plate, wherein the contact ends defining the output sections extend vertically to the base plate, and are configured as plug-in contacts, and wherein the contacts are guided through slots in the base plate, and the contact ends representing the input sections are provided parallel to each other and are aligned in a contact opening arrangement of the busbar adapter, which is configured in a mirror-symmetrical manner to a transverse axis.

8 Claims, 13 Drawing Sheets

CONNECTION MODULE FOR SWITCHING DEVICE AND CONNECTION RAIL

CROSS-REFERENCE TO RELATED APPLICATION

This Application is a Section 371 National Stage Application of International Application No. PCT/EP2008/061614, filed 3 Sep. 2008 and published as WO 2009/059824 on May 14, 2009, in German, the contents of which are hereby incorporated by reference in their entirety.

The invention relates to a connection module for connecting a switching device to an adapter, and a switching device which has a connection module for connecting to an adapter.

DE 10 2006 022 3748 sets out a switching device, in particular a safety load disconnection switch, which can be operationally connected to an adapter which is itself positioned on conductor rails for contacting of the conductor rails. In this switching device, the adapter is constructed in such a manner that the switching device can be placed in the first position, and in a second position rotated through 180° without modifications having to be made to the current outputs of the switching device or the current inputs of the adapter. So that the switching device can be placed on the adapter in two possible positions, that is to say, with connections at the top or connections at the bottom, the output contacts of the switching device are intended to be adapted to the inputs of the adapter.

Such a configuration of the switching device and adapter does not allow different switching devices to be used, unless the output contacts thereof are adapted to the adapter.

The object of the invention is to provide a connection module and a switching device having a connection module which allows the use of different devices, in particular switching devices, when using a predetermined adapter with different securing and contact elements with respect to the device or switching device.

This object is achieved according to the invention with a connection module which is provided in particular for use between a switching device and a conductor rail adapter, having a base plate which has a plurality of contacts which are arranged parallel with each other and parallel with the longitudinal axis of the base plate, the contacts having as input and output portions contact ends which are located substantially in the same plane, the contact ends which form input portions being arranged at one side of the base plate and the contact ends which form output portions being arranged at the opposite side of the base plate, wherein the contact ends which secure output portions extend vertically relative to the base plate and are constructed as plug-type contacts, wherein the contacts extend through slots in the base plate and the contact ends which constitute output portions are provided parallel with each other and are orientated with respect to the contact opening arrangement of the conductor rail adapter which is constructed in a mirror-symmetrical manner relative to a transverse axis.

The dependent claims relate to other configurations.

The above object is further achieved with a switching device, in particular a load disconnection switch, in which the connection module is arranged at the lower side of the switching device, the connection module being constructed so as to be able to be placed on an adapter and the adapter having a base plate in which there are constructed openings which are provided in a mirror-symmetrical manner relative to a transverse axis and so as to correspond to the position of the output portions, electrical conductors for contacting by the output portions of the connection module being provided below the openings of the adapter.

The invention provides a connection module and a switching device having a connection module, by means of which various switching devices could be fitted to one and the same type of adapter, and it being possible for the switching device to be positioned on the adapter in two securing positions which are rotated relative to each other through 180°. It is consequently possible to produce in particular an electrical connection in accordance with the "British Standard".

According to the invention, it is ensured that an extremely large variety of switching devices can be used with one and the same adapter construction, it being possible, using a connection module, to use switching devices which allow conventional construction with a contacting by means of connection sleeves or the like. In this manner, it is possible to use, for example, a switching device as described in DE 297 21 440.

In order to explain additional features, preferred configurations of the switching device according to the invention are described below, with reference to the drawings, in which:

FIG. 1 is a sectioned view of a switching device to clarify the arrangement of the contacts, and the associated adapter;

FIG. 2*a* is a detailed view of the input and output contacts and the associated contact rail which extends in the adapter;

FIG. 2*b* is an illustration corresponding to FIG. 2*a*, in which the plug-type contact is placed on the contact rail;

The invention is explained in greater detail below, with reference to the drawings.

Figure 1:
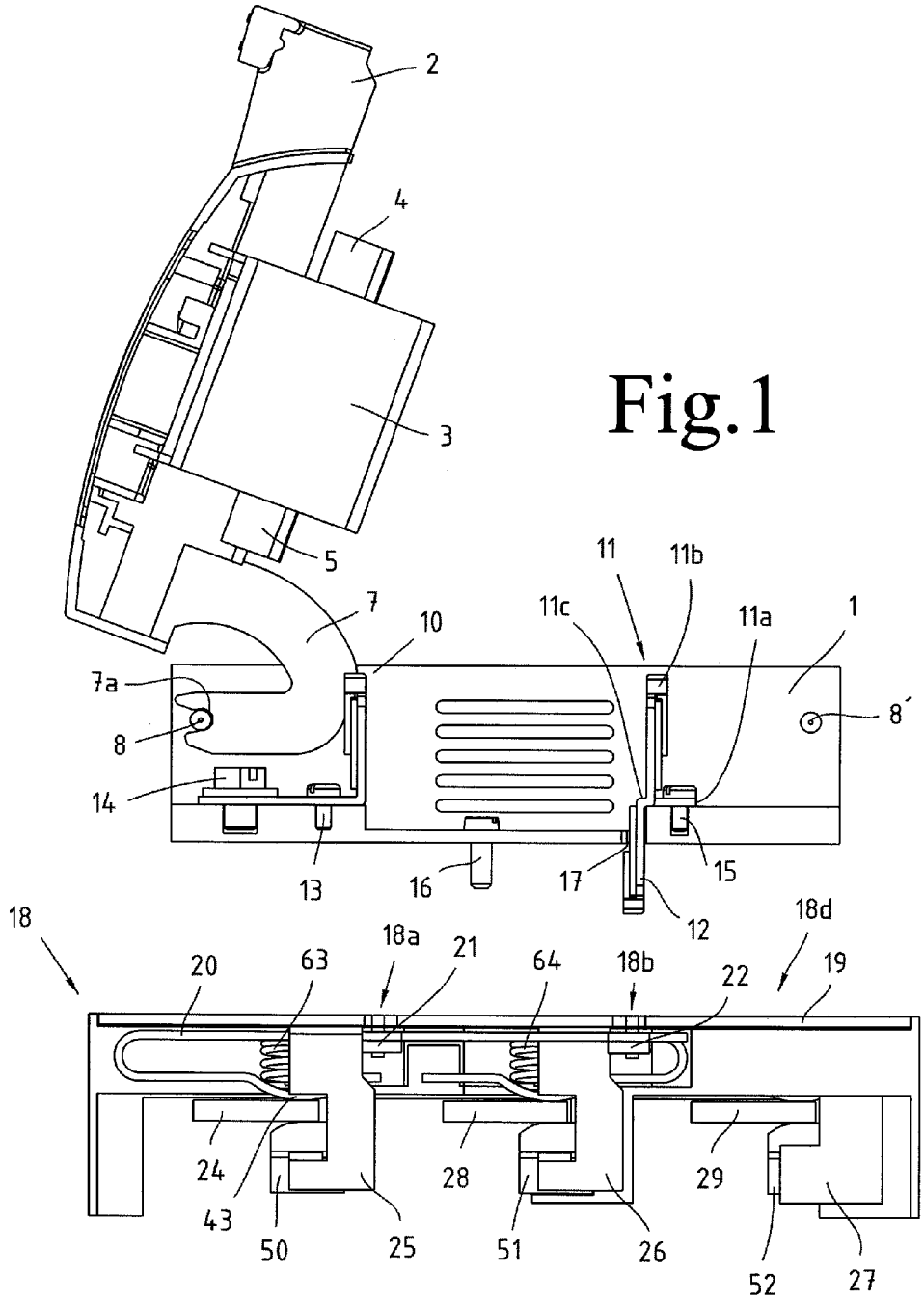

FIG. 1 illustrates a switching device which has a housing 1 and a cover 2 which is preferably articulated to the housing 1 so as to be able to be pivoted. The configuration illustrated in FIG. 1 is described in DE 10 2006 022 374. The cover 2 serves to receive one or more safety units. The safety units have contact blades for contacting the contacts described below in the housing 1. Such a safety unit is designated 3, and the contact blades are designated 4 and 5.

As can be seen in FIG. 1, the cover 2 is pivotably secured by means of pivoting feet 7 to retention devices 8, the retention devices 8 preferably being provided in the form of receiving studs or the like. At the inner side of the housing 1 there are two pairs of such retention devices 8, 8' which serve to secure the cover either to the pair of retention devices 8 or to the pair of retention devices 8', depending on how the housing is arranged with respect to the associated adapter 18 which is yet to be described. The housing 1 is generally in the vertical direction so that the cover 2 is pivotably arranged so as to be able to be folded open in an "upward" direction.

In the housing 1, with a three-pole switching device, there are three pairs of contacts 10, 11 which are provided opposite each other and which are used to receive the contact blades 4, 5 of the relevant safety unit 3 when the cover 2 is displaced in the direction of the housing 1 and closed.

In the configuration illustrated in FIG. 1, there is provided an output contact in the form of the contact 10 and an input contact 11 in the form of a plug-type contact, as will be explained in greater detail below. The plug-type contact 11 has a base portion 12 which extends out of the housing 1 in a downward direction through an opening 17 in the housing base 1*b* and protrudes with respect to the lower side 1*a* of the housing by a predetermined distance. The output contact 10, in the configuration illustrated, is preferably substantially L-shaped and is secured with respect to the housing base 1*b* by screw means 13 and further carries, on the member 10*a* which extends parallel with the housing plane, a clamping screw 14 for clamping a line end or the like. The plug-type contact 11 is secured to the housing base of the housing 1 by means of a member 11*a* which protrudes perpendicularly relative to the base portion 12 and screw means 15. The contacts 10 and 11 may be provided transposed with respect to FIG. 1.

In the configuration illustrated in FIG. 1, the plug-type contact 11 is constructed in such a manner that the base portion 12 is arranged so as to be offset in a parallel manner with respect to the receiving portion 11*b* thereof for the blade contact of the associated securing unit 3 owing to the construction of a shoulder portion 11*c* between the portion 11*b* and the contact portion 12. For details, reference is explicitly made to FIG. 1.

The shoulder portion 11*c* is located on the housing base 1*b* of the housing 1. In the housing base 1*b* there is an opening 17, through which the plug-type contact 11 extends with the base portion 12 thereof. In the housing base 1*b*, screw means 16 are further provided and are used to be able to secure the housing 1 to the adapter 18 therebelow.

As can be seen from FIG. 1, after closing the cover 2, the contact blades 4, 5 reach the contacts 10, 11 which are associated with the receiving regions 10*b*, 11*b*, whereby an electrical connection is produced between the input contact in the form of the plug-type contact 11 and the output contact 10.

The switching device is placed on the adapter 18, the base portion 12 of the plug-type contact 11 engaging via one of a pair of openings 18*a*, 18*b* with predetermined regions 21, 22 of a contact rail 20 and the electrical contact between the base portion 12 and the contact rail 20 thereby being produced. This is achieved when the housing 1 is placed on the adapter 18. The openings 18*a*, 18*b* are located in a base plate 18*d* of the adapter 18.

In the configuration illustrated in FIG. 1, the contact rail 20 is provided with two defined contact regions 21, 22 as will be set out in greater detail below. If the housing 1 is placed on the adapter 18, the base portion 12 comes into contact with the region 22 of the contact rail 20 which can itself be brought into electrical connection with one of the bus bar or conductor rail designated 24, 28, 29.

The adapter 18 further has feet 25, 26, 27 which are used to partially engage below the relevant bus bars 24, 28, 29 in order to allow the adapter 18 to be fitted to the bus bars 24, 28, 29, as known per se.

Figure 2A:
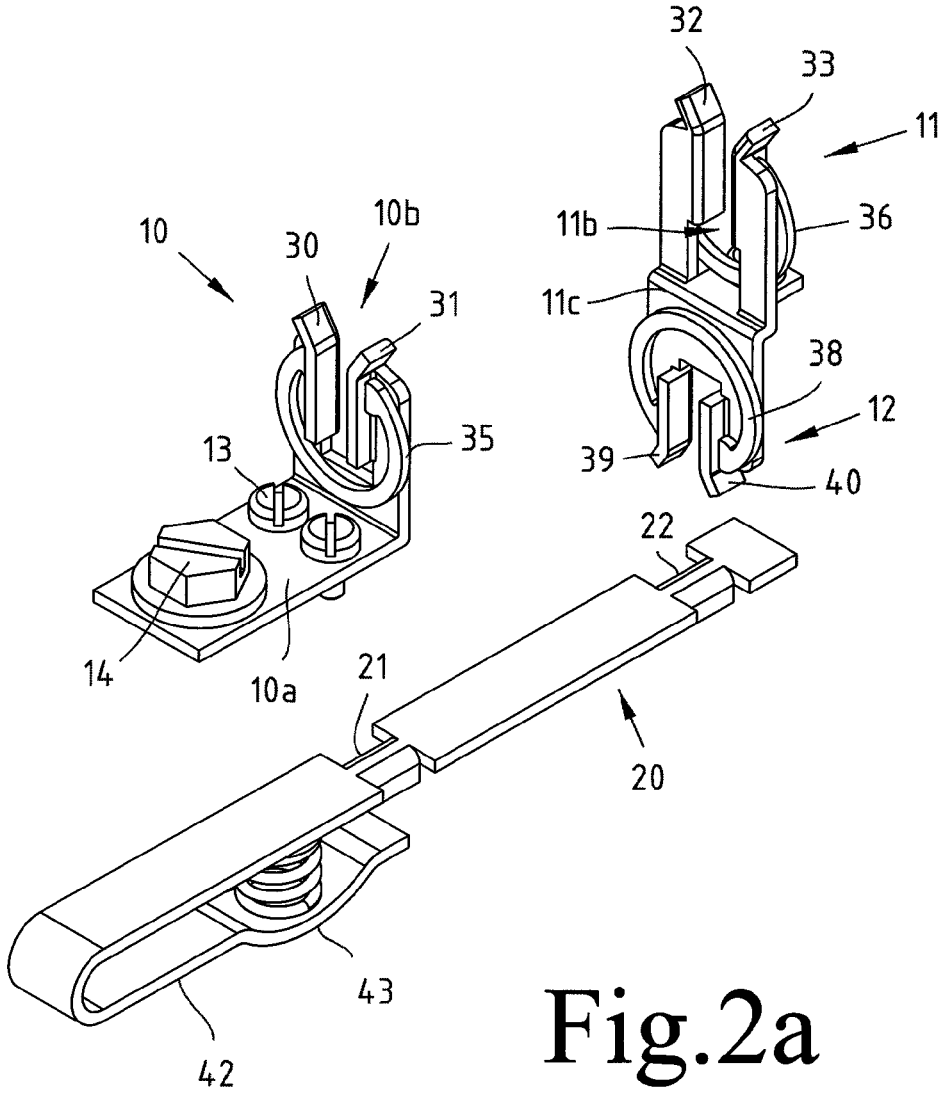

FIG. 2*a* illustrates a first configuration of the contacts 10, 11 which are used and the contact rail 20 of the adapter 18. Each contact 10, 11 is provided with contact members 30, 31 and 32, 33, respectively, which are pretensioned, for example, by means of a resilient ring 35 or 36 into a clamping position. The contact members 30, 31 or 32, 33 extend substantially parallel with each other and carry insertion regions which widen in an upward direction. A resilient ring 35 or 36 engages behind the members 30, 31 or 32, 33, respectively.

At the lower side of the plug-type contact 11 is the base portion 12 which is constructed in this embodiment in accordance with the upper contact portion with the components 32, 33, 36 and also has, for example, a resilient ring 38.

The contact rail 20 has regions 21, 22 which have a shorter width and which preferably extend in a conical or inclined or round manner in order to allow the plug-type contact 11 to be readily positioned with the base portion 12 thereof. To this end, the members 39, 40 of the base portion 12 are also laterally bent, whereby the fitting of the members 39, 40 to the portion 21 or 22 is facilitated.

The contact rail 20 has a downwardly bent tongue 42 which terminates in a downwardly curved arc 43. The arc 43 is used for contacting of the associated conductor rail.

Figure 2B:
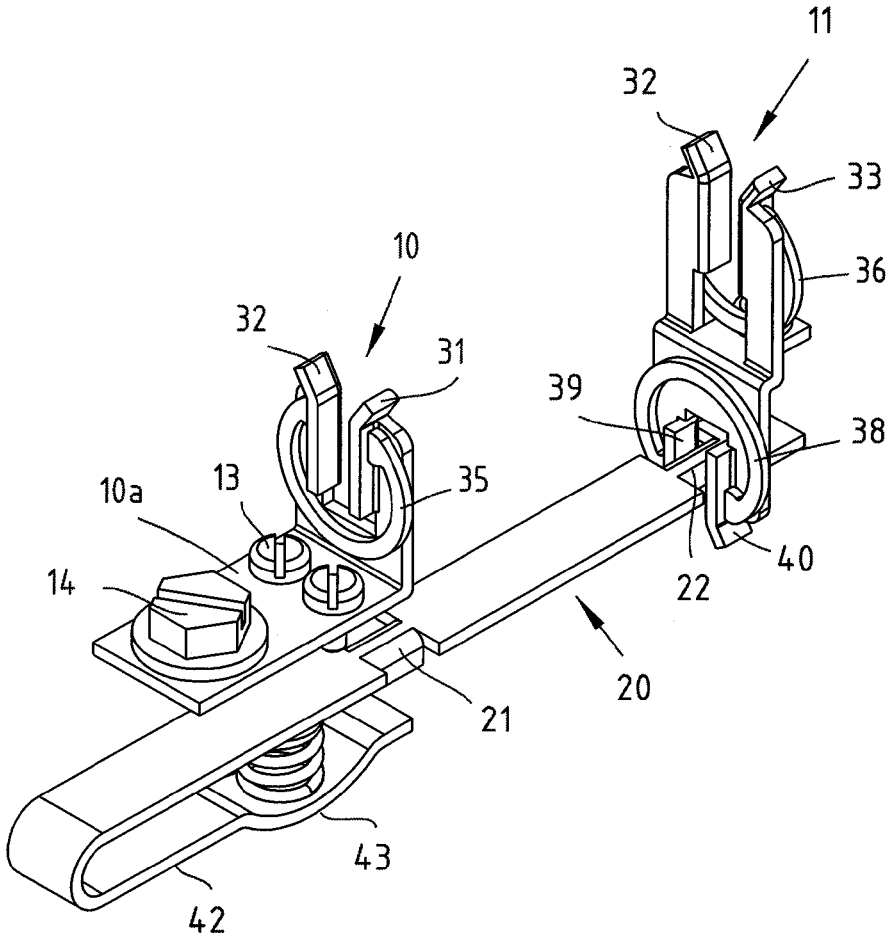

FIG. 2*b* is a view corresponding to FIG. 2*a*, the plug-type contact 11 being placed on the contact rail 20 and the guiding members 39, 40 of the plug-type contact 11 which widen in a downward direction being fitted over the portion 22. The plug-type contact 11 is consequently electrically connected to the contact rail 20.

Figure 3:
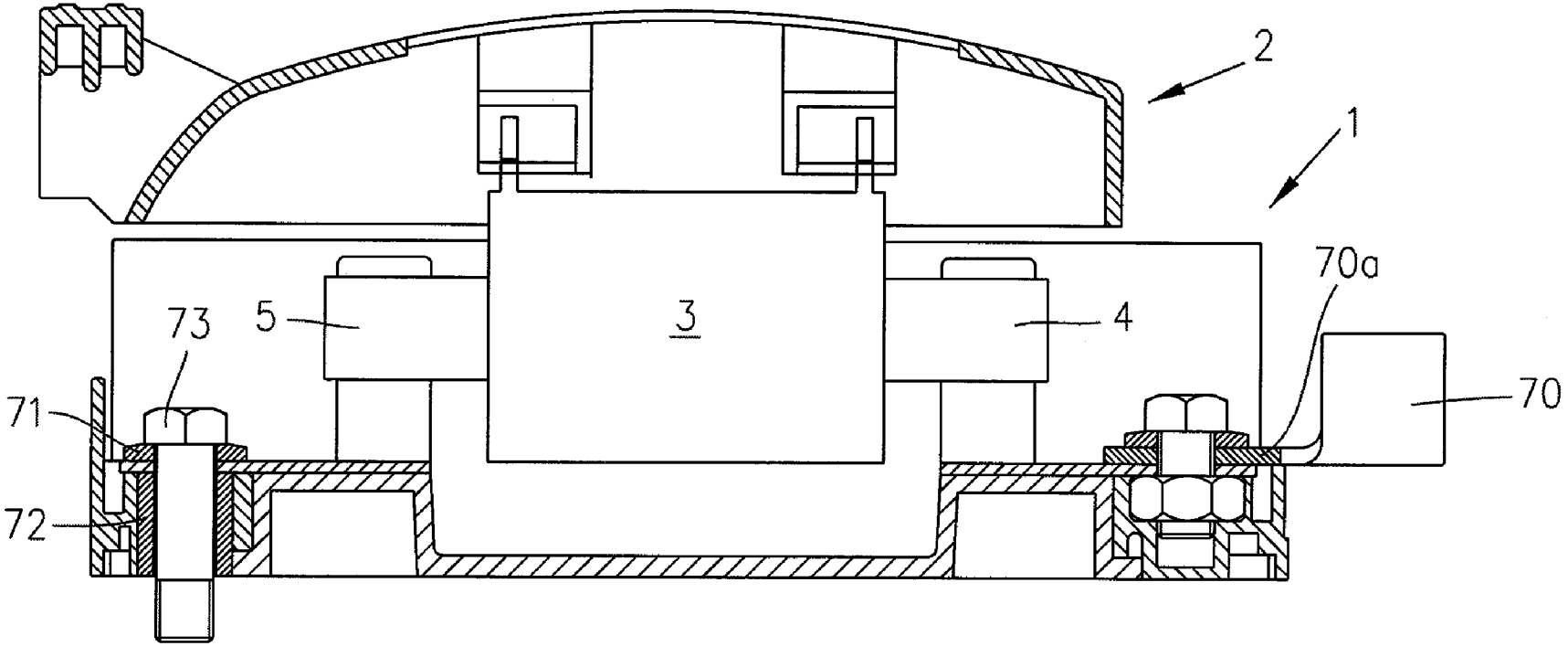
FIG. 3 is a schematic illustration of a switching device for use with the present invention.

In other switching devices, which, in contrast to the switching device illustrated according to FIG. 1, have no input and output contacts 10, 11 by means of which the switching device 1 can be placed on the adapter 18 and connected to the adapter 18, it is necessary, when using modules 18 of the type illustrated in FIG. 1, to implement another technical solution. A switching device constructed differently in this manner is illustrated in FIG. 3 by way of example. The components which are the same as in FIG. 1 have been given the same reference numerals. In this switching device 1 according to FIG. 3, with a three-pole switching device 3, there are provided cables 70 which are electrically connected to the safety unit 3 by means of a terminal 70*a* and further electrically connected in each case by means of one of three connections 71, as soon as the relevant safety unit 3 assumes the current-carrying state illustrated in FIG. 3 and the electrical connection between the input and output is consequently closed. From the connection 71, the electrical connection is guided downwards by a pipe piece or sleeve 72. When such a switching device 1 is used, the use of an adapter 18 according to FIG. 1 is clearly not possible and it is consequently also not possible to change the switching device 1 with respect to its connection direction.

According to the invention, however, it is desirable to use the adapter 18 together with an extremely large variety of switching devices, for example, also the switching device according to FIG. 3. This is achieved by using a connection module as set out in detail in FIGS. 4 and 5.

Figure 4:
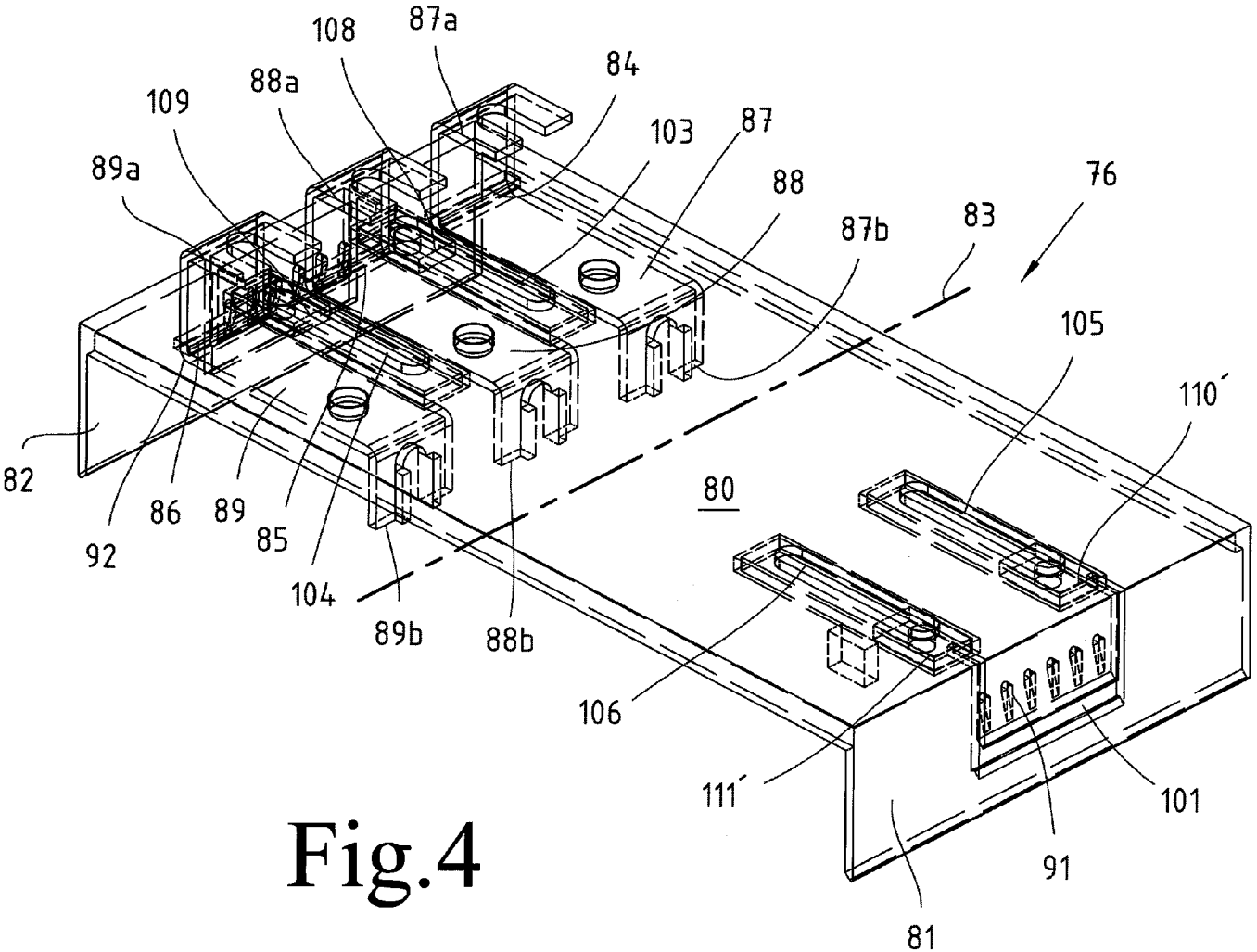
FIG. 4 is a perspective view of a preferred configuration of a connection module.
Figure 5:
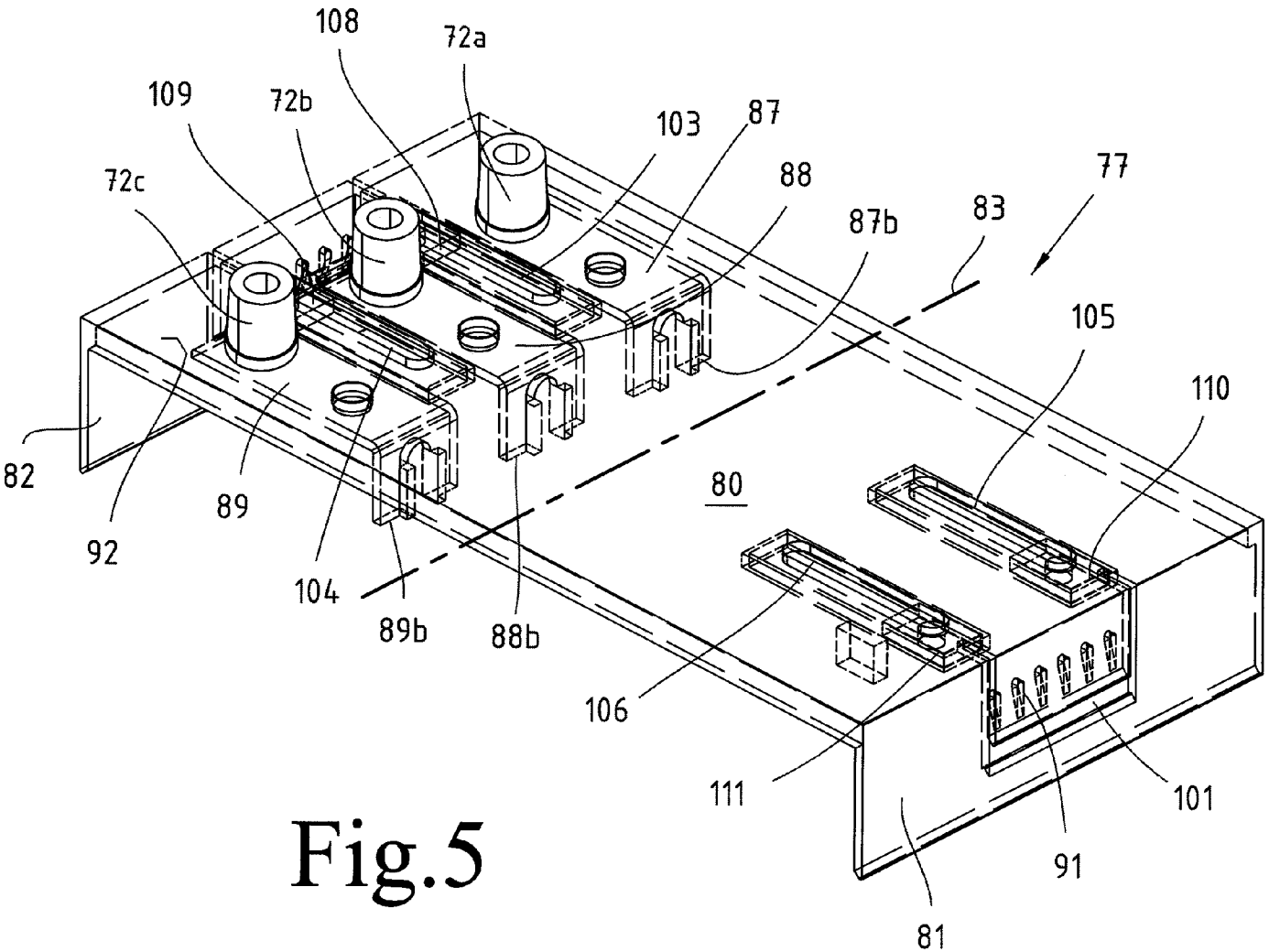
FIG. 5 is a perspective view of another preferred configuration of a connection module.
Figure 6:
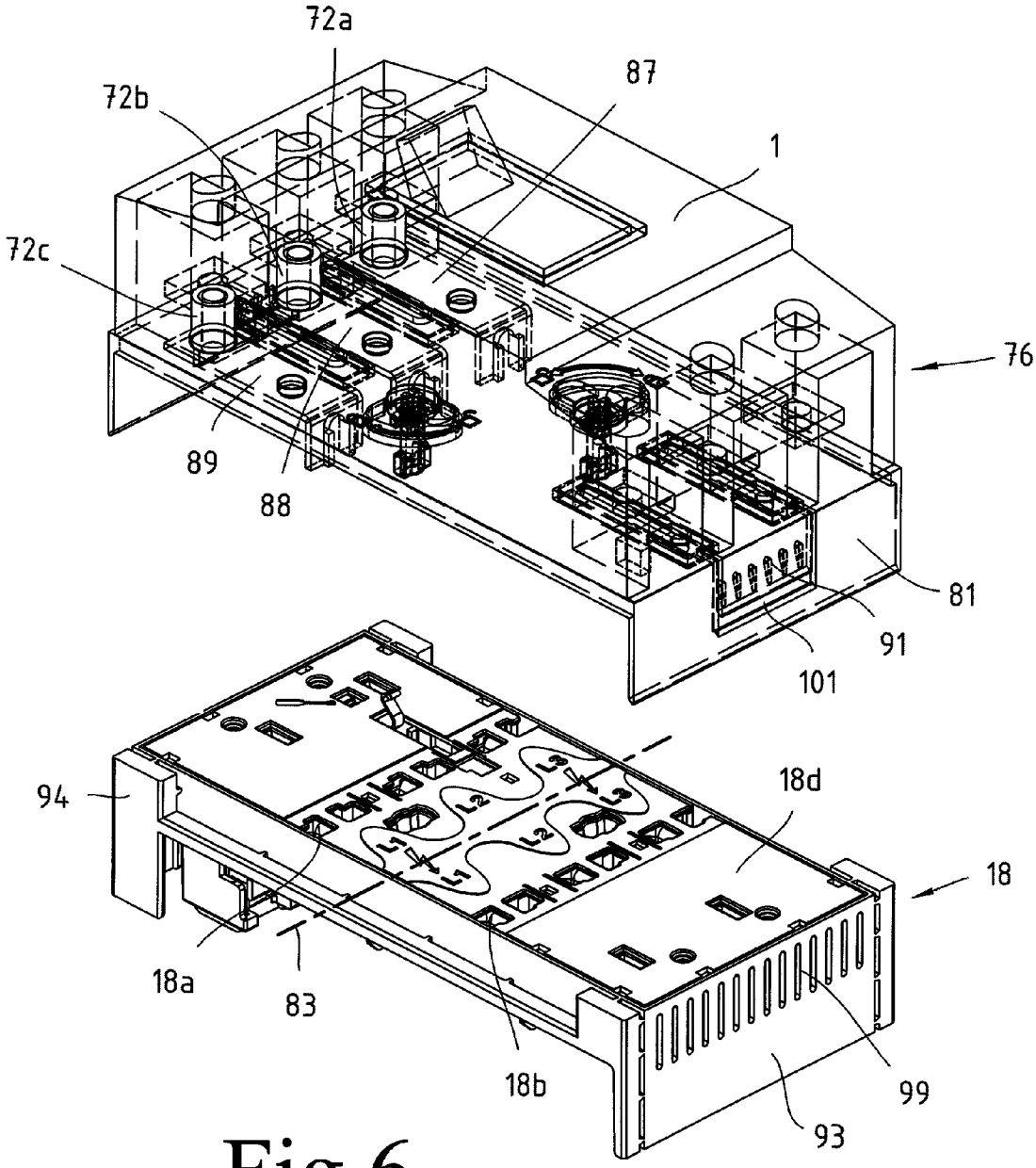
FIG. 6 is an exploded perspective view illustrating the use of a switching device with a connection module mounted therebelow and the associated conductor rail adapter.
Figure 7:
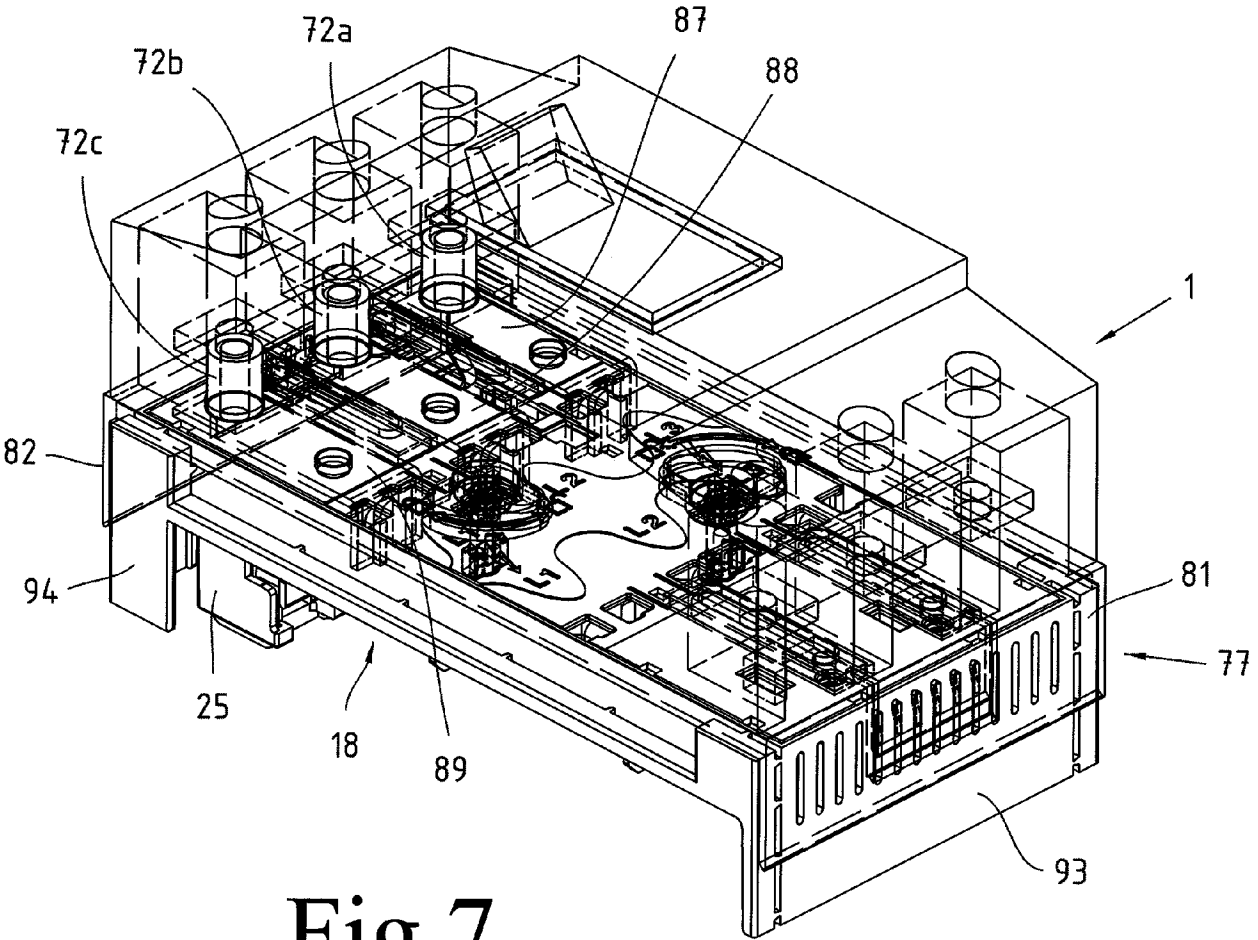
FIG. 7 is a view corresponding to FIG. 6 illustrating a complete unit, comprising a switching device, connection module and adapter.

In order to be able to fit such a switching device to the adapter 18 with a different connection direction, there is provided a connection module, of which a first alternative is illustrated in FIG. 4 and a second alternative in FIG. 5. FIG. 6 is a perspective, exploded view of a switching device 1 with no further detail, and below is the connection module 76, which is fitted in this case to the lower side of the switching device 1 and, remote therefrom, also a perspective view of the adapter 18. FIG. 7 is a perspective view in which the switching device 1, the connection module 76 and the adapter 18 are joined together.

The variant of a connection module 76 illustrated in FIG. 4 will be explained in greater detail below.

The connection module 76 comprises a base plate 80 having members 81, 82 which support laterally at least in a downward direction and which are preferably provided at an angle of 90° relative to the base plate 80. The base plate 80 is provided with slots or openings 84, 85 86 which are preferably located in a mirror-symmetrical manner relative to a transverse axis 83 and which are formed close to the members 82, 83 and serve to form through-openings through which contacts extend. In the configuration according to FIG. 4, the individual contacts comprise substantially Z-shaped contacts 87, 88, 89. The ends of these electrical contacts in the form of copper conductive strips or the like are structured in a fork-like manner. The upwardly directed ends of the contacts 87, 88, 89 are designated 87*a*, 88*a*, 89*a* and extend according to FIG. 8 parallel with the base plate 80 whilst the contact ends which protrude downwards in the connection module 76 are designated 87*b*, 88*b*, 89*b* and protrude perpendicularly downwards with respect to the base plate 80. The contact ends 87*a*, 88*a*, 89*a* are the input portions and the contact ends 87*b*, 88*b* and 89*b* are the output portions of the connection module. Although the contacts 87, 88, 89 can be seen in FIG. 4, it should be understood that the portions which extend below the base plate 80 would not actually be visible owing to the non-transparent material of the base plate 80.

In the connection module 76, the contacts 87, 88, 89 are provided at the left-hand side as seen in FIG. 4; optionally, these contacts can also be provided in a mirror-symmetrical manner relative to the transverse axis 83 at the right-hand side, as long as this is structurally possible and desirable.

The fork-like contact ends 87*a*, 88*a*, 89*a* engage in the connection region of a switching device or the like, whilst the lower contact ends 87*b*, 88*b*, 89*b* are sized and positioned in such a manner that they can be inserted precisely into the openings which are generally designated 18*a*, 18*b* and which are constructed in the adapter 18 (FIG. 6) and are described in connection with FIG. 1. Therefore, as soon as the connection module 76 is fitted to the respective switching device and the contact ends 87*a*, 88*a*, 89*a* have been brought into electrical connection with the respective connection contact 71 of the switching device 2 or the like, these two components, comprising the switching device 1 and the connection module 76 can be positioned together on the adapter 18 in order thereby to be connected to the counter-contacts or conductors formed at the lower side of the adapter 18 by means of the contacts 87, 88, 89. Since the adapter 18 is also designed symmetrically relative to the transverse axis 83, according to the present invention, the switching device 1 can be placed on the adapter together with the connection module 76 in two positions mutually rotated through 180° so that the connections of the switching device can be located at the "top" or at the "bottom". The terms "top" and "bottom" are intended to refer to the fact that the switching device according to FIG. 1 is generally placed in a position rotated through 90° in a clockwise direction relative to FIG. 1 on the conductor rails 24, 28, 29 which are provided parallel with each other in a vertical direction, or in a position rotated through 180° relative thereto, if the connections are intended to be located "at the bottom".

FIG. 6 illustrates how the contact ends 87*a*, 88*a*, 89*a* are brought into electrical contact, for example, with the sleeve-like connection elements 72, also referred to above as pipe pieces, that is to say, the contact ends 87*a*, 88*a*, 89*a* are located, for example, below each pipe piece 72 or above the pipe piece 72 below the screw head 73 (see FIG. 3).

In the variant of a connection module 77 illustrated in FIG. 5, the contacts 87, 88, 89 are substantially L-shaped with lower contact ends 87*b*, 88*b*, 89*b*, whilst, instead of the contact ends 87*a*, 88*a*, 89*a* according to FIG. 4, sleeves or pipe pieces are secured to the contacts 87, 88, 89 which correspond to the pipe pieces 72 in FIG. 3 and are accordingly designated 72*a*, 72*b*, 72*c* in FIG. 5.

The connection to the respective switching device is produced by fitting the switching device 1 to the connection module 77, the pipe pieces 72*a*, 72*b*, 72*c* then being brought into the position as illustrated in FIG. 3 with respect to the switching device 1 illustrated therein.

The contact ends 87*b*, 88*b*, 89*b* are constructed in the same manner as illustrated in connection with the connection module 76 (FIG. 4) and are used in the same manner to contact the corresponding contacts of the adapter 18 as soon as this connection module 77 is placed on the adapter 18. In the connection module 75 according to FIG. 5, the contacts 87, 88, 89 can also be provided in a mirror-symmetrical manner relative to the transverse axis 83, if this is desirable or advantageous.

In order to secure the connection modules 76, 77 to the adapter component 18, each connection module is provided in the region of the members 81, 82 with a flexible tongue 91, 92 which extends from the base plate 80 transversely relative to the base plate 80 inside the members 81, 82, but which can be moved freely relative to the members and is intended to allow clamping on the corresponding members 93, 94 (FIGS. 6 and 7) of the adapter 18.

Figure 8:
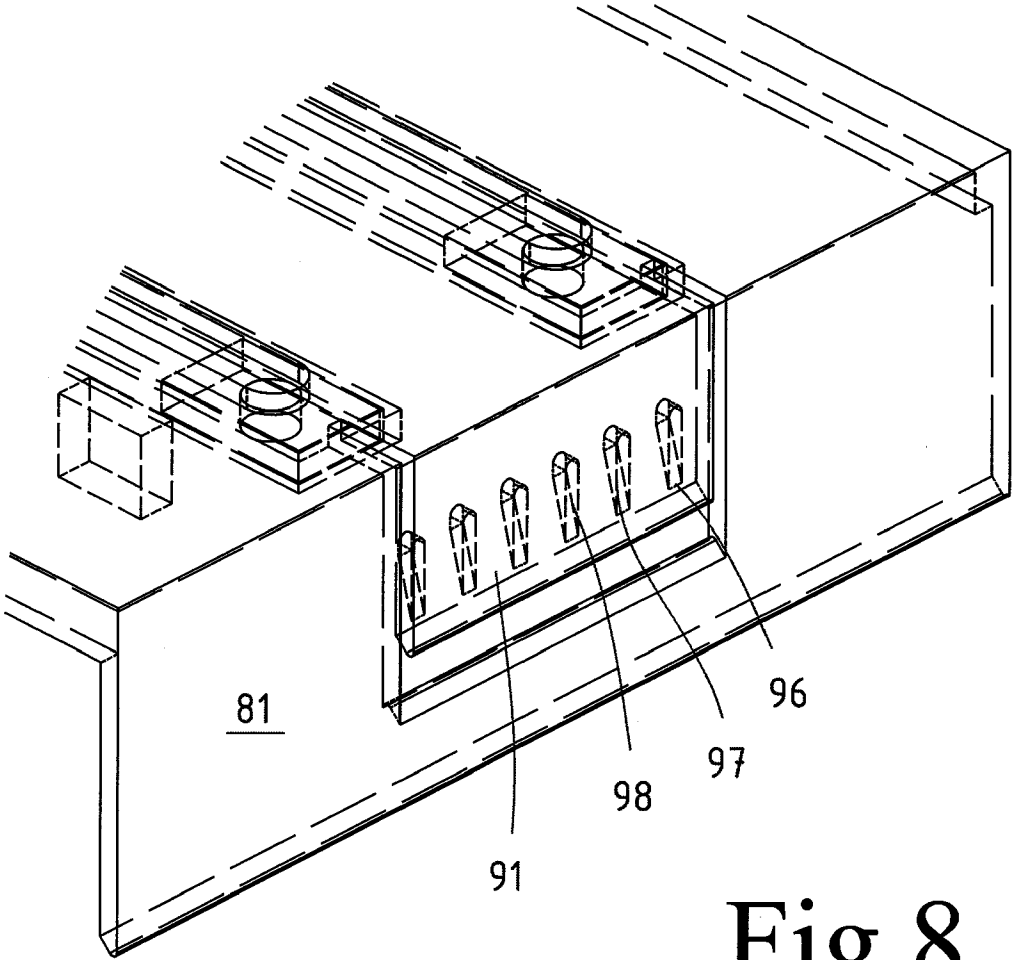
FIG. 8 is a partial view of the connection module, when viewed from below.

According to a preferred configuration, the tongues 91, 92 are provided at the inner face thereof with elongate grooves or teeth 96, 97, 98, as can be seen in FIG. 8, which is a view of the member 81 from the inside. These teeth 96, 97, 98, only some of which are illustrated, extend downwards in an inclined manner and have a width which substantially corresponds to the width of the slots which are provided laterally in the adapter 18 and are generally designated 99 in FIG. 6. The length of the slots 99 which are constructed parallel with each other and the length of the teeth 96 to 98 are adapted to each other in order to allow the teeth 96 to 98 to be arrested in the slots 99 after the connection module 76 or 77 is placed on the adapter 18.

Furthermore, in the region of the member 81, 82, the length of the tongue 91, 92 is limited in such a manner that there is left free between the relevant tongue 91 or 92 and the member 81 or 82, respectively, a slot 101 which is used to lift the tongue 91 or 92 by means of a tool when the connection module 76 or 77 is intended to be released from the adapter 18.

In the present invention, it is advantageous for the connection module 76, 77 to engage around the adapter 18 in a non-positive-locking manner so that the plug-type contacting between the switching device 2 and the connection module 76 or 77 is not loaded by the device weight of the switching device and is necessarily used only for transmission of current. The respective switching devices can advantageously be provided in a prefabricated manner on the respective connection module 76 or 77. In the event of damage, by rapidly refitting or replacing a switching device 2, the downtime of the entire unit is minimized.

Another advantage of the present invention involves the connection module being provided with universally adjustable or displaceable threaded plates. This is explained in greater detail with reference to FIG. 4. In the base plate 80, in the configuration illustrated in FIG. 4, there are constructed between the contacts 87, 88, 89 receiving grooves 103, 104 in which threaded plates 108, 109 are displaceably inserted, respectively. These threaded plates 108, 109 can consequently be displaced within the grooves 103, 104 which act as a guide and allow adaptation to the screw connection of the respective switching device.

Corresponding grooves 105, 106 which act as a guide are formed on the opposing side of the base plate 80 of the connection module 76 or 77 and displaceably receive threaded plates 110, 111. These threaded plates 110, 111 also serve to receive securing means which are introduced from the switching device into the connection module.

Owing to the displaceably arranged threaded plates 108 to 111, different devices and/or switching devices can be secured to the connection modules 76, 77.

Owing to the construction of the connection module 76 or 77 according to the invention, it is configured in such a manner that it can receive the associated connection contact elements of the respective switching device, which may be in the form of single-piece connection rails and which are provided in a prefabricated state for the connections of the switching devices, or are formed by means of flexible connections or pipe pieces in the form of spacer pipes. Consequently, the connection module according to the invention allows the universal use of different equipment and/or switching devices.

In the connection module according to the invention, the inputs are provided one beside the other in the form of contact ends 87*a*, 88*a*, 89*a* in a three-phase device each protruding at the same height from the base plate 80. The contact ends at the output side, which are designated 87*b*, 88*b*, 89*b*, also have substantially the same length and are also located one beside the other, the contacts 87, 88, 89 being arranged parallel with each other on the base plate 80.

Figure 9:
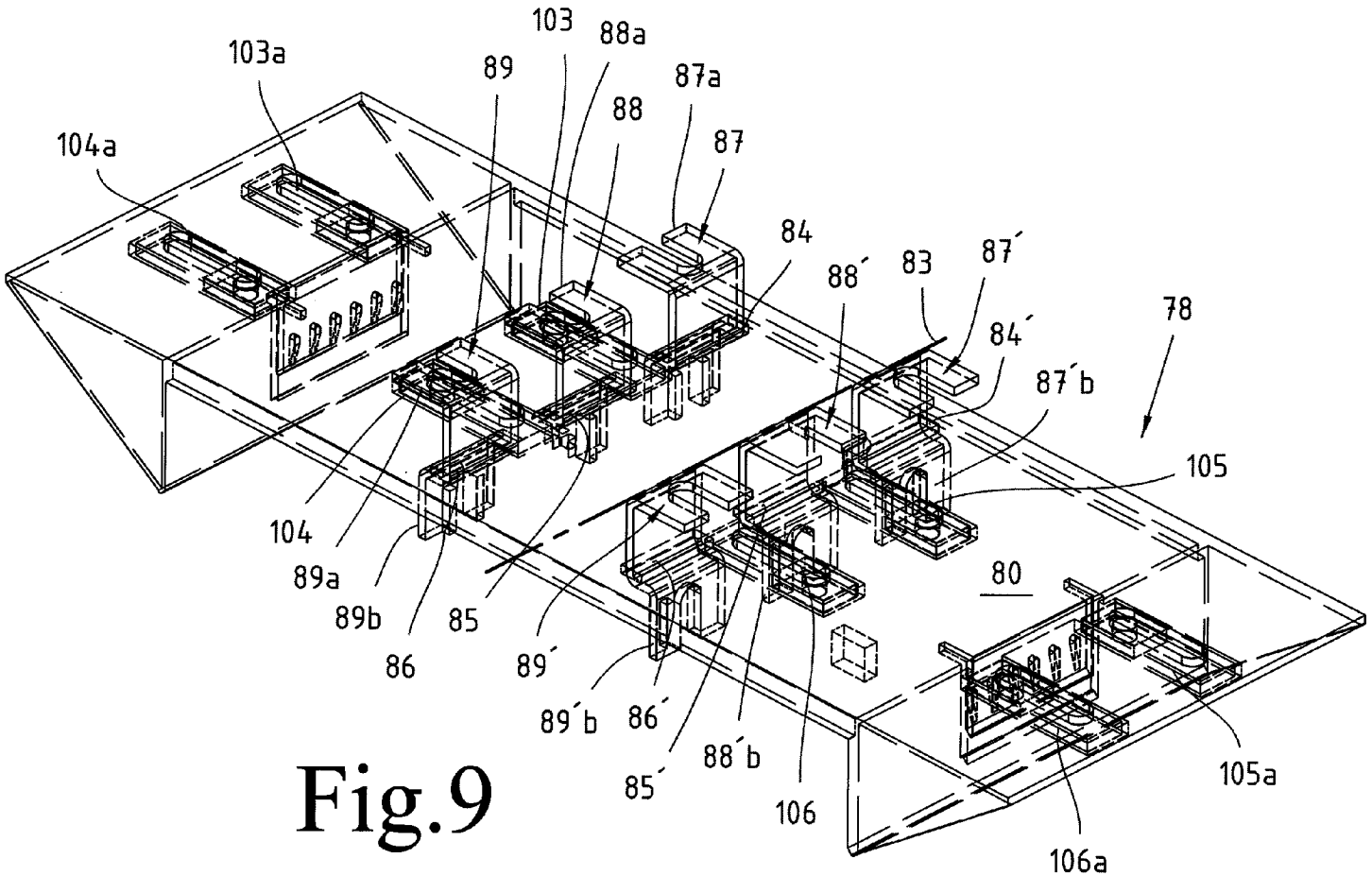
FIG. 9 is another modified configuration of a connection module.

There is described below yet another configuration of a connection module which is illustrated in FIG. 9 and which can be used for receiving two switching devices. In this instance, the two switching devices are formed by smaller or shorter units as shown in connection with FIGS. 6 and 7. Accordingly, this connection module 78 has a base plate 80 having a series of slots 84, 85, 86 and 84', 85', 86' which are provided in a mirror-symmetrical manner relative to the transverse axis 83 and serve to receive the contacts 87, 88, 89 and 87', 88', 89' which are illustrated therein. The upper contact ends 87*a*, 88*a*, 89*a* are parallel with the plane of the base plate 80 and are constructed in a fork-like manner and merge into a perpendicularly extending portion which is followed by a portion which extends parallel with the base plate 80 and which extends below the base plate 80 and which the lower contact ends then adjoin, which are not illustrated in greater detail for reasons of clarity and which are preferably constructed in a fork-like manner. These contacts 87, 88 etc. substantially correspond to the contacts explained in connection with FIG. 4; they have a shorter portion parallel with the base plate 80 compared with FIG. 4 and are provided in a mirror-symmetrical manner relative to the axis 83. In this manner, it is possible to position a switching device both from the left-hand side and right-hand side in FIG. 9 in order to connect it to the associated connections of the switching device in the manner described with reference to FIG. 4. The contacts 87', 88', 89' are provided in a mirror-symmetrical manner relative to the axis 83 with respect to the contacts 87, 88, 89. There are further duplicated receiving grooves 103, 104, 103*a*, 104*a* and 105, 106, 105*a*, 106*a* with the threaded plates which are not indicated in FIG. 9 for reasons of clarity with respect to the variant of FIG. 5.

The contact ends 87*b*, 88*b*, 89*b* which are formed at the lower side of each connection module 76, 77, 78 are constructed as plug-type contacts and have the function of being inserted into counter-contacts of the adapter 18 when the connection module 76, 77, 78 is placed on the adapter 18. By placing the connection module 76, 77, 78 on the adapter 18, the electrical connection to the strip conductors or contact elements provided in the adapter 18 is produced practically automatically.

As can be seen from the above description, the adapter 18 has a plate 18*d* which contains the through-openings or openings 18*a*, 18*b* for the plug-type contacts of the connection module.

From the above description, it can be seen that the connection module according to the invention and the associated adapter 18 can be used for the operation of an extremely wide variety of switching devices, for example, also so-called safety load disconnection switches.

Figure 10:
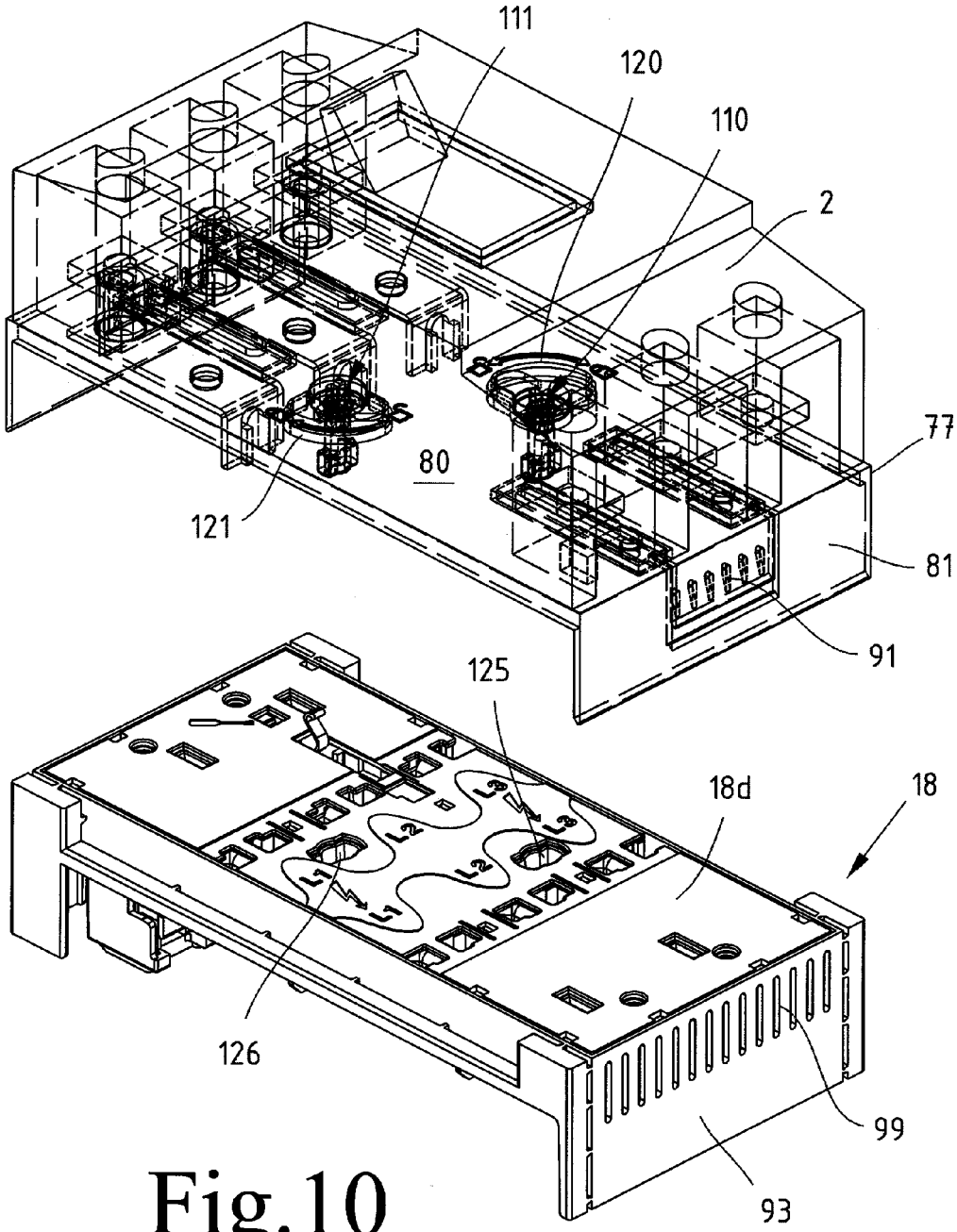
FIG. 10 is an exploded illustration of another configuration of a unit, comprising a switching device, connection module and adapter.
Figure 11:
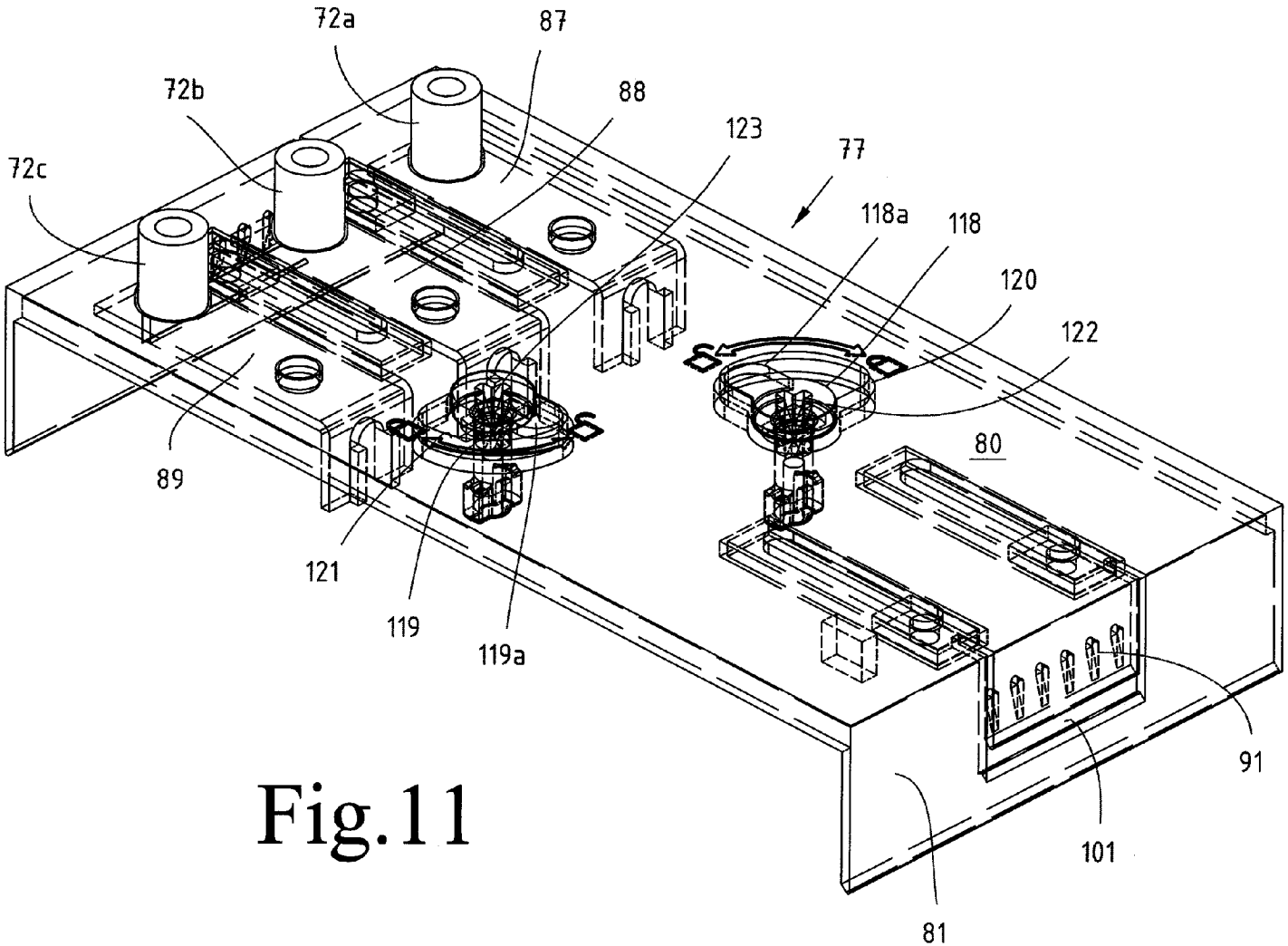
FIG. 11 is a detailed view of a connection module used with the unit according to FIG. 10.

Another configuration is illustrated by way of example in FIGS. 10 and 11. According to FIGS. 10 and 11, there is provided a connection module which, in the description of FIGS. 4 to 9, may have the various input and output portions explained therein. Although, in FIGS. 9 and 10, the connection module designated 77 and described above is used, the connection modules according to FIGS. 4, 5, 9 can also be equipped in the manner described below.

Figure 12:
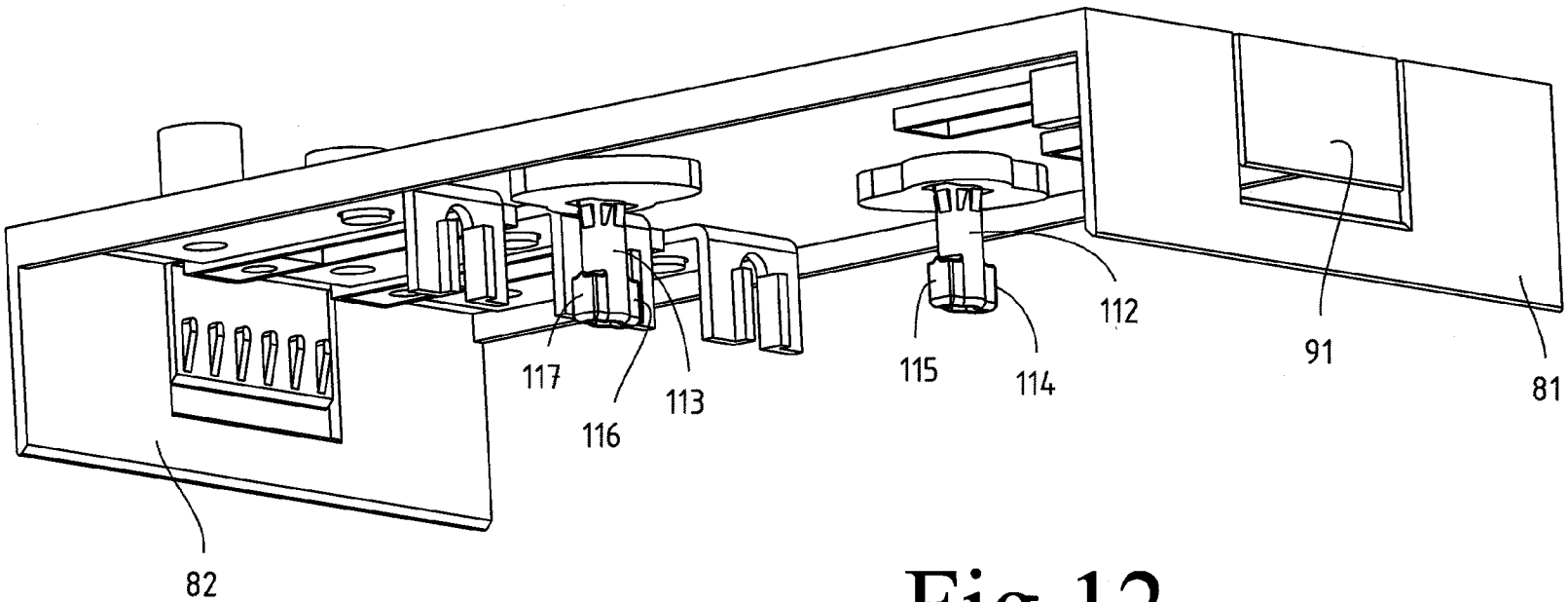
FIG. 12 is a view of the connection module according to FIG. 11, when viewed from below.

As can be seen from FIGS. 10 and 11, each connection module 76, 77, 78 may be provided with locking devices 110, 111 in order to securely lock the relevant connection module both with respect to the switching device 2 and the adapter 18 which is located therebelow. Details of these locking devices 110,111 can be seen in FIGS. 10 to 12.

Each locking device 110, 111 has a preferably cylindrical pin 112, 113, at the lower end of which laterally protruding, tooth-like locking members 114 to 117 are formed. Each pin 112, 113 has according to FIGS. 10 and 11 at the upper end thereof a locking bar 118, 119 with a tongue 118*a*, 119*a* which protrudes therefrom. In the configuration illustrated, there is in the base plate 80 an at least partially circular recess which preferably extends over an angle of 90° and which is designated 120, 121. In the surface of each locking bar 118, 119 there is preferably provided a cross-like slot 122, 123 which acts as an engagement device for a screwdriver or the like in order to be able to activate the locking device. The recess 120, 121 is constructed so as to be recessed in the base plate 80 and acts at the same time as a guide for the locking bars 118, 119 whilst it is rotated, for example, through 90°. In the base plate 18*d* of the adapter 18, there are provided openings 125, 126 which are preferably provided diametrically opposed to each other with respect to the transverse axis 83 (FIG. 5) and serve to allow the pin 112, 113 to be guided through in such a manner that the tooth-like locking members 114 to 117 can be brought into engagement with respect to the lower face of the base plate 18*d* when the locking bars 118, 119 are rotated into the locking position. To this end, the tooth-like locking members 114 to 117 have according to FIG. 12 a predetermined spacing relative to the lower face of the base plate 80 which is selected in such a manner that the locking devices 110, 111 can be moved as far as a location below the base plate 18*d* of the adapter 18. The shaping of the openings 125, 126 substantially corresponds to the cross-section of the locking devices 110, 111 in the region of the tooth-like locking members 114 to 117. Alternatively, the openings 125, 126 may also be provided in pairs at both sides of the transverse axis 83 in the adapter 18.

In the configuration illustrated, two openings 125, 126 are provided in the base plate 18*d* of the adapter 18 and two locking devices 110, 111 are arranged in the connection module, respectively.

As can be seen, the tongues 118*a*, 119*a* of the locking bars are used to limit the rotational movement of the bars over an angle of, for example, 90° in accordance with the recess 120, 121 in the base plate 80 of the connection module.

Using the locking devices 110, 111 described above, a non-positive-locking connection is ensured between the adapter 18 and the switching device 2 if these locking devices are provided. In the configuration illustrated, the locking devices 110, 111 can be produced in addition to the lateral lockings between the tongues 91, 92 and the slots 99 in the members 93, 94 of the adapter 18.

The locking devices 110, 111 can be used with respect to the connection modules illustrated regardless of the type of contacts 87, 88, 89 used.

The invention claimed is:

1. A connection module, for use between a switching device and a conductor rail adapter, comprising:

a base plate which has a plurality of Z-shaped contacts;

wherein the contacts have input portion contact ends which are upwardly directed from the connecting module and output portion contact ends which are located at the lower side of the connecting module, wherein the contact ends which form the input portions are arranged at one side of the base plate and the contact ends which form the output portions are arranged on another or other side of the base plate, being opposite to said one side;

wherein the contact ends which secure output portions extend perpendicular relative to the base plate and are constructed as plug-type contacts, wherein the base plate is provided with slots and the conductor rail adapter comprises contact openings;

wherein the contacts extend through said slots in the base plate and the contact ends which constitute said output portions are provided parallel with each other and are orientated with respect to said contact openings of the conductor rail adapter which are provided in a symmetrical manner relative to a transverse axis of the conductor rail adapter in the conductor rail adapter, wherein the base plate further comprises grooves for receiving displaceably guided threaded plates which are provided to secure the switching device, wherein the contact ends are formed by fork-like portions or connection sleeves, and wherein the base plate comprises members which are arranged laterally on the base plate and wherein inside of said members flexible clamping tongues are provided, wherein the clamping tongues are provided at the inwardly directed face thereof with locking devices for engaging the adapter in a non-positive locking manner.

2. The connection module of claim 1, wherein the contacts are inserted in a mirror-symmetrical manner relative to a transverse axis in the base plate.

3. The connection module of claim 1, wherein the base plate comprises members which are arranged laterally on the base plate and wherein inside of said members flexible clamping tongues are provided.

4. The connection module of claim 1, wherein the base plate receives locking devices.

5. The connection module of claim 1, wherein the base plate receives locking devices, and the locking device comprising locking bars and locking members which are spaced-apart relative to the locking bars.

6. A switching device, in particular a safety load disconnection switch, comprising:

a connection module with a base plate which has a plurality of Z-shaped contacts;

wherein the contacts have input portion contact ends which are upwardly directed from the connecting module and output portion contact ends which are located at the lower side of the connecting module, wherein the contact ends which form input portions are arranged at one side of the base plate and the contact ends which form the output portions are arranged on another or other side of the base plate, being opposite to said one side;

wherein the contact ends which secure output portions extend perpendicular relative to the base plate and are constructed as plug-type contacts, wherein the base plate is provided with slots and a conductor rail adapter comprises contact openings;

wherein the contacts extend through said slots in the base plate and the contact ends which constitute said output portions are provided parallel with each other and are orientated with respect to said contact openings of the conductor rail adapter which are provided in a minor-symmetrical manner relative to a transverse axis of the conductor rail adapter in the conductor rail adapter, wherein the connection module is arranged at the lower side of the switching device and the connection module is placed on said adapter, the adapter comprises a base plate with openings which are provided in a symmetrical manner relative to said transverse axis and corresponding to the position of the output portions, said adapter further comprising electrical conductors for contacting by the output portions of the connection module;

wherein the connection module further comprises locking devices, said locking devices containing locking members and locking bars, wherein the locking members are engaged with the base pate, wherein the contact ends are formed by fork-like portions or connection sleeves, and wherein the base plate comprises members which are arranged laterally on the base plate and wherein inside of said members flexible clamping tongues are provided, wherein the clamping tongues are provided at the inwardly directed face thereof with locking devices for engaging the adapter in a non-positive locking manner.

7. The switching device of claim 6, wherein the connection module is secured by means of locking devices in locking slots in the members of the adapter for securing the connection module to the adapter in a non-positive-locking manner.

8. The switching device of claim 6, wherein the switching device further comprises connections, wherein the contact ends of the connection module forming the input portions are electrically connected to the switching device connections.

* * * * *